United States Patent [19]
Wichmann et al.
[11] 4,318,337
[45] Mar. 9, 1982

[54] SOURCE CAPTURE FUME REDUCTION APPARATUS

[75] Inventors: Frederick R. Wichmann, Cincinnati; James C. Bricker, Waynesville, both of Ohio

[73] Assignee: United Air Specialists, Inc., Cincinnati, Ohio

[21] Appl. No.: 166,303

[22] Filed: Jul. 7, 1980

[51] Int. Cl.[3] ..... B08B 15/04
[52] U.S. Cl. ..... 98/115 VM; 98/115 R
[58] Field of Search ..... 98/115 R, 115 VM, 43 R; D23/151, 163, 167; 15/415 R; 126/299 R, 299 D, 299 E, 299 F; 55/DIG. 18

[56] References Cited

U.S. PATENT DOCUMENTS

| | | | |
|---|---|---|---|
| 2,567,776 | 9/1951 | Lundy | 98/115 R |
| 2,855,837 | 10/1958 | Bakke | 98/1 |
| 3,279,681 | 10/1966 | Banolow | 98/115 R X |
| 3,818,817 | 6/1974 | Nederman | 98/115 VM |
| 3,880,062 | 4/1975 | Culpepper, Jr. et al. | 126/299 E |
| 3,926,104 | 12/1975 | ElDorado | 98/115 VM |
| 4,163,650 | 8/1979 | Watson et al. | 98/115 R X |
| 4,177,975 | 12/1979 | Meyers et al. | 98/115 R X |

FOREIGN PATENT DOCUMENTS

| | | | |
|---|---|---|---|
| 573877 | 4/1959 | Canada | 98/115 R |
| 847612 | 7/1970 | Canada | 98/115 R |
| 1023242 | 3/1953 | France | 98/115 R |
| 2004056 | 3/1979 | United Kingdom | 98/115 VM |

*Primary Examiner*—Albert J. Makay
*Assistant Examiner*—Harold Joyce
*Attorney, Agent, or Firm*—Frost & Jacobs

[57] ABSTRACT

Apparatus for providing source capture of fumes produced at a work station including a molded aerodynamically designed fume capture hood positionable above the work station, a mounting mechanism for providing vertical movement of the hood such that the orientation of the hood opening remains constant, a fume collection system for removing material contained in air captured by the hood, and a flexible conduit connecting the collection system to the hood. The contours associated with the forward parts of the upper and side wall portions of the hood minimize entrance loss and turbulence to provide a coefficient of entry of at least about 0.93, while the contour associated with the forward part of the upper wall portion permits a higher velocity near the top of the hood for insuring suction of fumes, vapors or smoke near an operator's breathing zone. The mounting mechanism includes a vertical stanchion, a carriage slidably movable along the stanchion, pantograph-like mounting arms securing the hood to the carriage, and a constant force spring secured between the stanchion and the carriage, the spring acting to compensate for the weight of the hood and the conduit to maintain the hood at a desired vertical position.

10 Claims, 10 Drawing Figures

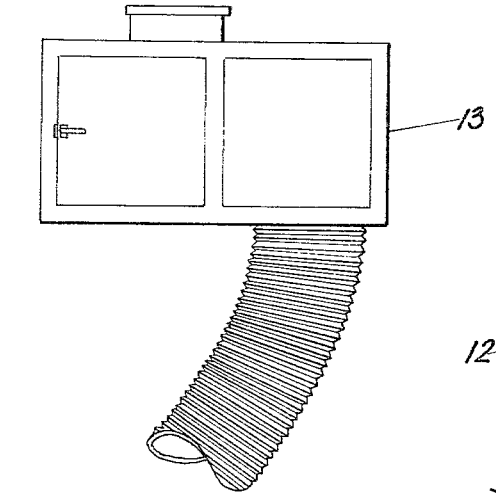
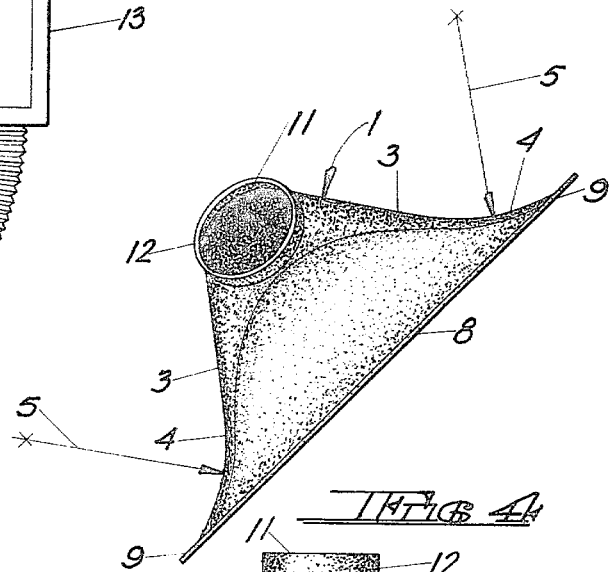
FIG 4
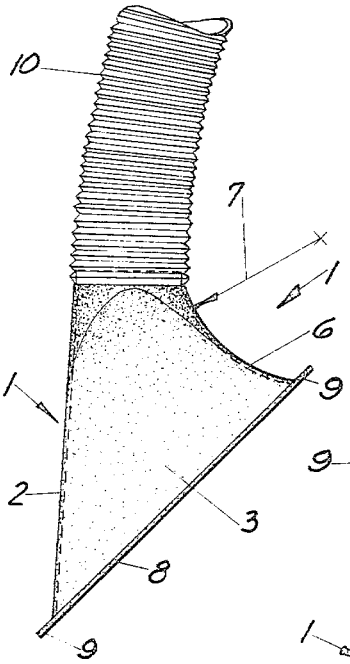
FIG 5
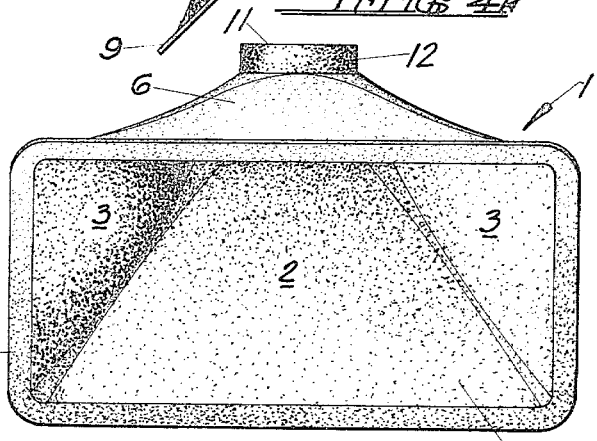
FIG 1
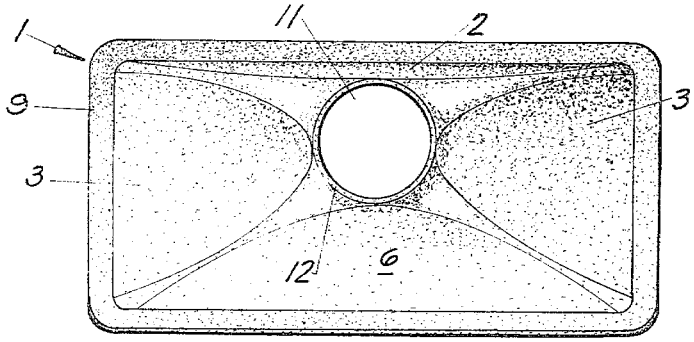
FIG 2

SOURCE CAPTURE FUME REDUCTION APPARATUS

SUMMARY OF THE INVENTION

Recent attempts to provide more stringent occupational safety and health regulations have intensified the search for better ways to improve air quality in industrial environments. This need has been found particularly acute in manufacturing operations which produce large quantities of vapors, fumes or smoke such as large scale welding operations, particularly those processes using electric arc welding. While small concentrations of these noxious pollutants may be tolerated, concentrations of appreciable size constitute a recognized health hazard since the smoke contains particles of respirable size which by-pass the body's natural filters and lodge in the lungs where they are usually retained, eventually causing respiratory problems. Similar problems occur in industrial operations involving brazing, soldering, machine operations, plastic and rubber forming, etc.

One method which has been suggested for reducing the concentration of noxious pollutants in the working area is through the use of an air cleaning system which continually removes particulate material or vapors in the air, and returns the resulting clean air to the work area. While such an arrangement has proven effective in some industrial operations, it has been found that a considerable number of large air cleaning units are necessary to handle processes, such as electric arc welding, which produce large amounts of smoke or fumes in a short period of time. Such units are expensive to maintain and operate, and must be positioned accurately to insure effective air cleaning.

A more practical solution involves positioning a fume or smoke collector such as a hood, dome or the like near the work station to capture the smoke or fumes at their source. The captured vapors, fumes or smoke may be conducted by means of a duct or conduit to a suitable air cleaning device such as a two stage electrostatic precipitator or solvent recovery system. In some installations it is possible for a number of source capture hoods to be served by a single strategically placed efficiently operating air cleaning system.

The simplest type of source capture device comprises a conical or bell-shaped hood positioned in a fixed position overlying the work station. While such an arrangement effectively captures a large portion of the vapors, fumes or smoke produced to prevent pollution of the atmosphere outside of the work station, the operator is continually subjected to high concentrations of noxious pollutants.

It has been proposed to overcome this disadvantage by providing a positionable hood such as that illustrated in U.S. Pat. No. 3,818,817, issued June 25, 1974 to Nederman. In such an arrangement, a suction casing or hood is connected by means of a complex mechanical linkage to a flexible conduit which directs fumes or smoke from the work station to a suitable suction fan. The hood may be selectively positioned at various horizontal and vertical positions as close to the work station as desired to capture the vapors, fumes or smoke and protect the operator from high concentrations of pollutants. However, inasmuch as most source capture hoods of this type are fabricated from sheet metal or the like, it is generally impossible to aerodynamically contour the shape of the hood to insure effective capture at all positions. Consequently, the hood must be made unnecessarily large, thereby interfering with the operation being performed, or a considerable amount of vapor, fumes or smoke permitted to escape around the edges of the hood. Furthermore, the mechanical positioning mechanisms associated with prior art source capture hoods require unnecessarily complex mechanical linkages and may prove difficult for an operator to effectively position during a machining or welding operation, for example.

The source capture fume reduction apparatus of the present invention, on the other hand, seeks to overcome the disadvantages of prior art source capture hood arrangements. In a preferred embodiment, the present invention includes a fume capture hood having optimized interior aerodynamic contouring for minimizing entrance loss and turbulence, thereby increasing the total volume of air cleaned, resulting in a smaller electrostatic precipitator or solvent recovery air cleaning system. In particular, the capture hood comprises a rear wall portion extending upwardly and forwardly within about 3° of perpendicular, and a pair of spaced generally vertical side wall portions extending smoothly forwardly from the side edges of the rear wall portion such that the forwardmost sections of the side wall portions flare outwardly to define concave cylindrical surfaces. An upper concave cylindrical wall surface extends smoothly forwardly and downwardly from the upper edges of the rear and side wall portions, with the forward edges of the side and upper wall portions defining a generally rectangular front opening sloping forwardly and upwardly at about 45°. The contours associated with the forward parts of the upper and side wall portions minimize entrance loss and turbulence to provide a coefficient of entry of at least 0.93, while the contour associated with the forward part of the upper wall portion produces a higher velocity near the top of the hood for insuring suction of fumes, vapors or smoke near an operator's breathing zone.

Means are associated with the upper end of the hood for attaching a conduit to exhaust fumes collected within the hood and include an opening extending into the hood and defined by the confluence of the upper edges of the rear, side and upper wall portions. The flexible conduit attaches the capture hood to a suitable air cleaning system such as a two stage electrostatic precipitator, solvent recovery system, or the like.

Means are also provided for mounting the capture hood for vertical adjustment proximate the work station such that the orientation of the forward opening remains constant during movement of the hood. In a preferred embodiment, the mounting means includes a vertical stanchion, a carriage slidably vertically along the stanchion, a pair of parallel spaced arms pivotally attached at their ends to the carriage and hood, respectively, extension springs connecting the carriage and the hood for holding the hood in a desired pivotal position, and a constant force spring secured between the upper end of the stanchion and the carriage, the constant force spring acting to compensate for the weight of the hood and any attachments thereto such as the conduit to maintain the hood at a desired vertical position. In alternative embodiments, the mounting means may be modified to provide for only vertical or pivotal movement, as required.

As will be explained in more detail hereinafter, the smoothly contoured shape of the capture hood may be formed by casting or molding the hood from an electrically non-conducting, non-flammable material such as plastic, fiberglass or the like. As will become apparent from the detailed description which follows, this structure is highly superior to prior art capture hoods constructed of metal and the like which would be prohibitively expensive if formed to include the contours associated with the present invention.

BRIEF DESCRIPTION OF THE DRAWING

FIG. 1 is a front elevation view of the source capture hood of the present invention.

FIG. 2 is a top plan view of the source capture hood of the present invention.

FIG. 3 is a fragmentary side elevation view of the source capture fume reduction apparatus of the present invention.

FIG. 4 is an elevational view of the source capture hood of FIG. 3 viewed in the direction of arrow A.

DETAILED DESCRIPTION

Figure 5:
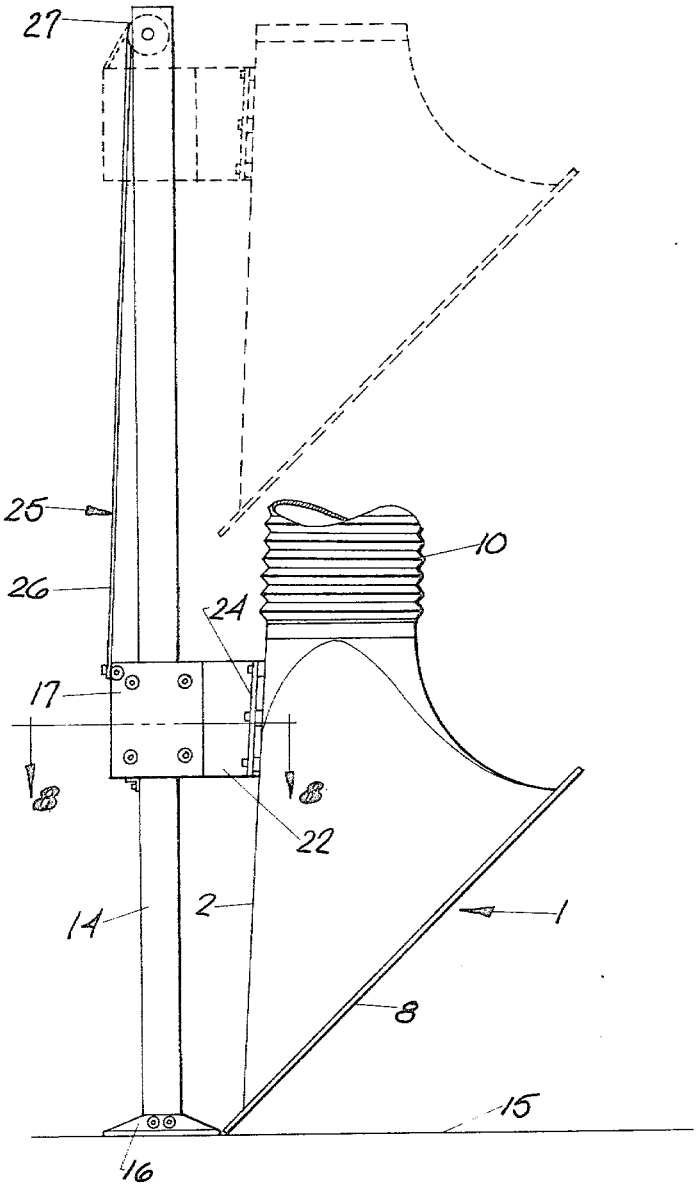
FIG. 5 is a fragmentary side elevation view of a first embodiment for the mounting structure of the source capture fume reduction apparatus of the present invention with the source capture hood shown in an alternate position.

The fume capture hood, shown generally at 1, is illustrated in FIG. 1–FIG. 4. Hood 1 comprises a generally bell-shaped structure having a rear wall portion 2 extending upwardly and forwardly within about 3° of perpendicular. As will become apparent from the detailed description which hereinafter follows, the slight inward slope of rear wall portion 2 serves to direct and channel fumes, vapors or smoke drawn into hood 1 toward the outlet of the hood, thereby serving to increase the capture efficiency of the device. A pair of spaced generally vertical side wall portions 3 extend smoothly forwardly from the side edges of rear wall portion 2 such that the forwardmost sections of the side wall portions flare outwardly as at 4 to define concave cylindrical surfaces. As best illustrated in FIG. 4, for a typical hood structure having a front opening of 24×36 inches, the radius of concave cylindrical surfaces 4 as depicted by radius lines 5, will be approximately 15 inches.

An upper concave cylindrical wall surface 6 extends smoothly forwardly and downwardly from the upper edges of the rear and side wall portions. For the hood dimensions as described above, the radius of upper wall surface 6 as depicted by radius line 7 will be approximately 10 inches.

The forwardmost edges of the side wall portions 3 and upper wall portion 6 define a generally rectangular front opening 8 which will slope forwardly and upwardly at an angle of about 45° with respect to the horizontal when the hood is positioned adjacent the work station. A thin outwardly flaring flange 9 extends around the periphery of front opening 8 to channel vapors, fumes or smoke into the capture hood 1.

It will be observed that all of the contours associated with capture hood 1, and in particular those associated with the forward parts of the upper and side wall portions, minimize entrance loss and turbulence by eliminating sharp edges which heretofore have restricted airflow. The long radii associated with side wall portions 3 and upper wall surface 6, together with flange 9 served to provide a smooth entrance for air entering the hood. A capture hood constructed in accordance with the details of the present invention will provide a coefficient of entry $C_e$ of at least about 0.93. The reduction of air restrictions associated with capture hood 1 permits the same amount of air to be drawn into the hood with a smaller fan or other suction producing device. Consequently, more hoods may be served by the same suction element.

It has also been found that orienting front opening 8 at an angle of approximately 45° with respect to the horizontal provides optimum collection for capture of certain types of noxious pollutants, and in particular welding smoke. As will become apparent from the detailed description which follows, the angle of the front opening 8 in the present invention remains constant as the vertical and horizontal position of the hood is varied, thereby preventing alteration of the optimum angle by the operator. As a result, the high efficiency of the unit is maintained throughout its adjustment range.

The smoothly contoured concave surface of upper surface 6 also serves to increase the velocity of the incoming air at the top of the hood. Since this portion of hood 1 will generally be positioned adjacent the breathing zone of the operator as the smoke rises from the work station beneath the hood, a larger proportion of noxious vapors, fumes and smoke will be drawn into the hood, thereby providing increased protection for the operator.

Means are associated with the upper end of the hood 1 for attaching a flexible cylindrical conduit, shown generally at 10, to exhaust fumes collected within the hood. The attaching means includes a generally circular opening 11 defined by the confluence of the upper edges of rear portion 2, side wall portions 3, and upper wall surface 6. Opening 11 is provided with an upstanding peripheral flange 12 for mating the hood 1 to conduit 10. Additional means, not shown, may be utilized to clamp the conduit to the hood as is well known in the art.

The terminal end of flexible conduit 10 is attached to a suitable air cleaning system such as the two stage electrostatic precipitator 13 illustrated in FIG. 3, which serves to remove particulate material from fumes and smoke captured by hood 1. In a preferred embodiment, electrostatic precipitator 13 may be of the type manufactured by United Air Specialists, Inc. under the trademark SMOG-HOG. It would be understood, however, that other types of air cleaning systems 13 may be used as required depending upon the particular type of noxious pollutants collected. For example, in situations where solvent vapors are collected by capture hood 1, air cleaning system 13 may comprise a solvent recovery system such as that manufactured by Allied Air Products, Newberg, Oregon, under the trademark KON-DEN-SOLVER.

To insure that the interior aerodynamic surfaces of the contoured welding hood are maintained, the hood may be fabricated by molding or casting from a suitable material such as plastic, fiberglass or the like. Not only does this insure that the smooth interior surfaces of the hood will reduce air restriction, but also that the hood will be light weight, essentially unbreakable, fire resistant and electrically non-conducting. All of these features are important in industrial environments where the possibility of fire or electrical shock is ever-present. This method of fabrication is a significant departure from prior art source capture hoods, which are generally made of metal, and cannot be economically formed to provide optimum capture efficiency. Consequently, such hoods are generally fabricated in a conical shape or as a rectangular duct having a slightly flared opening.

As noted above, the present invention also includes means for mounting the capture hood 1 for vertical adjustment proximate the work station such that the orientation of the forward opening 8 remains constant during movement of the hood. In a first embodiment, illustrated in FIG. 5 and FIG. 8, such mounting means comprise an elongated vertical channel-like stanchion 14 of substantially square cross section, fixedly secured at its lower end to the work station surface 15 by a suitable mounting bracket 16. It will be understood that stanchion 14 will be positioned so that opening 8 of welding hood 1 overlies the vapor, fume or smoke producing area of the work station.

Figure 8:
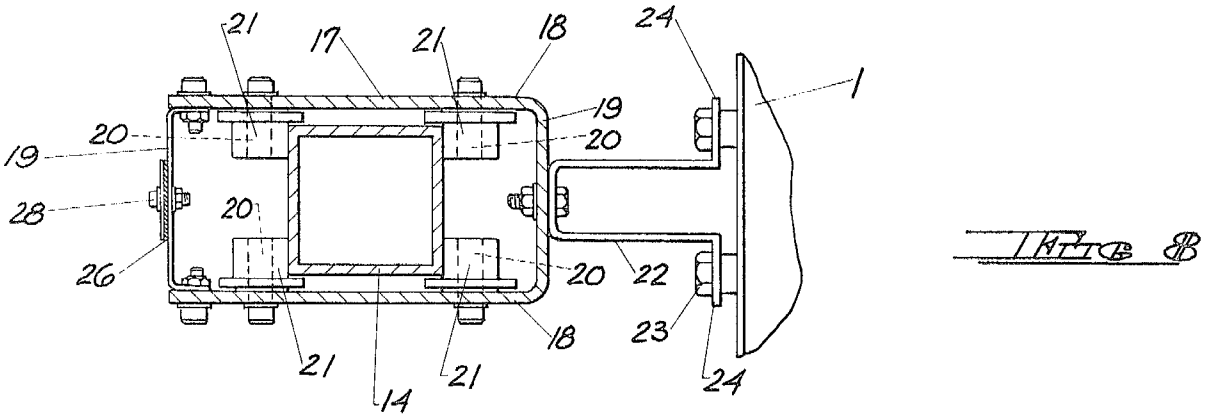
FIG. 8 is a fragmentary cross-sectional view taken along section line 8—8 of FIG. 5.

A box-like wheeled carriage 17 of substantially rectangular cross-section is positioned coaxially within stanchion 14 as best shown in FIG. 8. Carriage 17 includes a pair of spaced parallel vertically oriented side walls 18 joined by spaced parallel vertically oriented end walls 19. A pair of spaced horizontal generally cylindrical axles 20 extend inwardly from carriage side walls 18, and rotatably support flanged wheels 21. Axles 20 are spaced such that the outer surfaces of flanged wheels 21 bear against the associated vertical surfaces of stanchion 14, thereby permitting carriage 17 to move in a vertical direction smoothly therealong.

Capture hood 1 is secured to carriage 17 by mounting means comprising a generally U-shaped bracket 22 secured by means of bolts or other fasteners 23 between hood 1 and carriage 17. As best illustrated in FIG. 5, the outwardly extending vertical mounting flanges 24 of mounting bracket 22 will be angled slightly in the vertical direction such that rear wall 2 of hood 1 is displaced approximately 3° from the perpendicular. At the same time, the hood is oriented such that front opening 8 is oriented at an angle of approximately 45° with respect to the horizontal surface forming work station 15.

The present invention is also provided with means associated with carriage 17 for automatically holding hood 1 at a preselected vertical position. In the embodiment of FIG. 5, the holding means comprises a constant force spring, indicated generally at 25. Constant force spring 25 comprises a narrow band-like strip 26 of a thin flexible springy material such as spring steel or the like which is secured to and coiled about a spool-like holder 27. As illustrated in FIG. 5, the lowermost end of strip 26 is secured to rear end plate 19 of carriage 17 as at 28, while the upper end of strip 26 is secured to spool-like holder 27, which is in turn rotatably attached to the upper end of stanchion 14. It will be understood that when hood 1 is raised from the position illustrated in FIG. 5 to the position depicted by dashed lines, the spring-like strip 26 will automatically be wound onto spool 27. In addition, the force exerted by strip 26 of constant force spring 25 will act to compensate for the weight of hood 1 and any attachments thereto such as conduit 10 to maintain the hood at a desired vertical position. In other words, unlike a conventional spring which exerts a force proportional to the distance it has been stretched or compressed, constant force spring 25 will exert substantially the same force regardless of the vertical position of hood 1. As a result, hood 1 may be effortlessly raised and lowered by the operator to the desired vertical position to provide the most effective capture of vapors, fumes or smoke.

Figure 6:
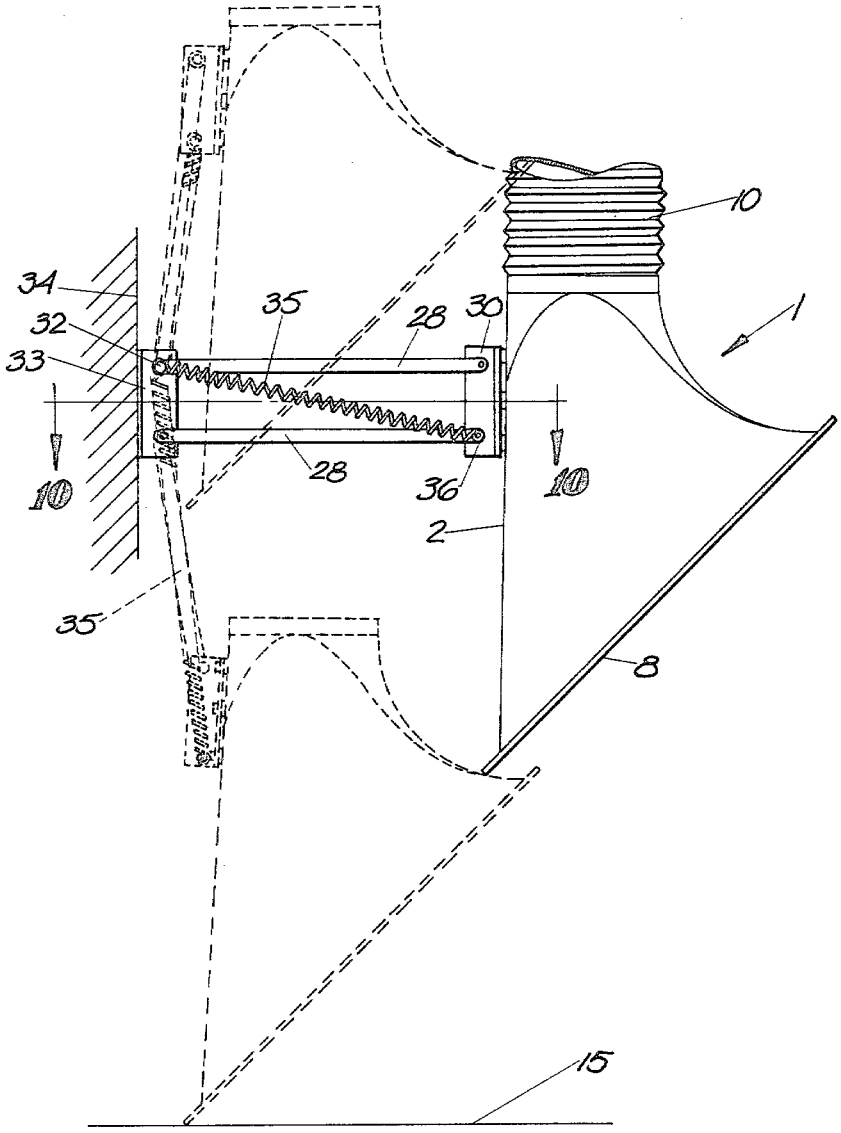
FIG. 6 is a fragmentary side elevation view of a second embodiment of the mounting structure for the source capture fume reduction apparatus of the present invention with the capture hood illustrated in alternate positions.
Figure 10:
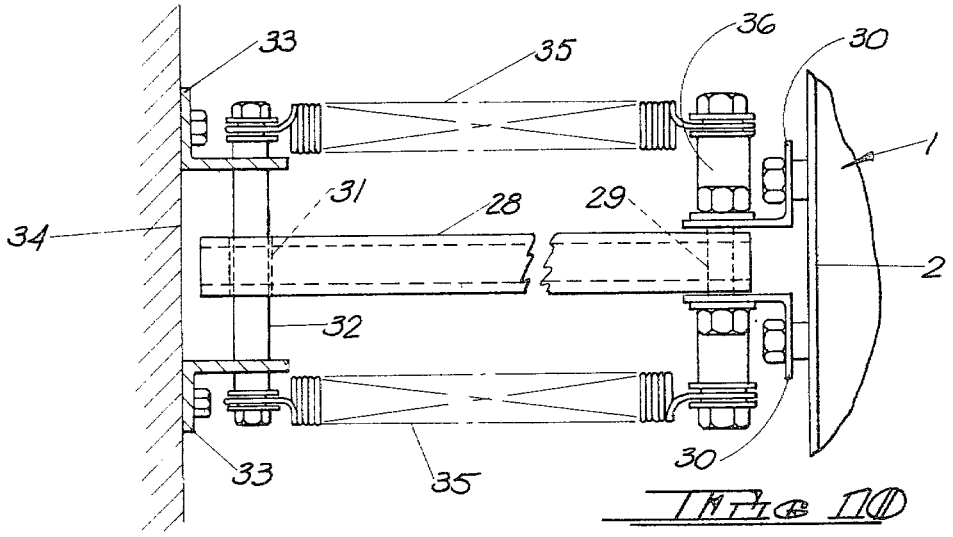
FIG. 10 is a cross sectional view taken along section line 10—10 of FIG. 6.

A second embodiment of the hood mounting means is illustrated in FIG. 6 and FIG. 10. In this arrangement, the mounting means comprises a pair of upper and lower parallel spaced arms 28 pivotally attached as at 29 by means of a pair of spaced L-shaped mounting brackets 30 extending rearwardly from rear wall 2 of hood 1. The other ends of arms 28 are pivotally secured as at 31 to a pair of vertically spaced cylindrical pivot rods 32 fixedly mounted by means of spaced L-shaped mounting brackets 33 to vertical wall surface 34. An extension coil spring 35 is positioned on each side of arms 28, and secured at one end to the lowermost horizontally extending pivot bar 36 supported by the inwardly extending arms of bracket members 30, and at the other end to the ends of the uppermost horizontally extending pivot bar 32.

It will be observed that this arrangement permits capture hood 1 to move pivotally to a number of different vertical positions over a range of approximately 160°, as indicated by the extremes of movement indicated by dashed lines in FIG. 6. Furthermore, as a result of the pantograph-like linkage movement provided by spaced arms 28, capture hood 1 will be maintained in the same orientation throughout the range of movement, particularly with respect to the angle of front opening 8, and the relative orientation of the contoured surfaces and back wall 2. Finally, extension springs 35 are selected such that capture hood 1, and any attachments thereto such as flexible conduit 10, will remain in a selected vertical position. As a result, the operator may easily adjust the vertical position of the capture hood to accommodate various work station conditions.

Figure 7:
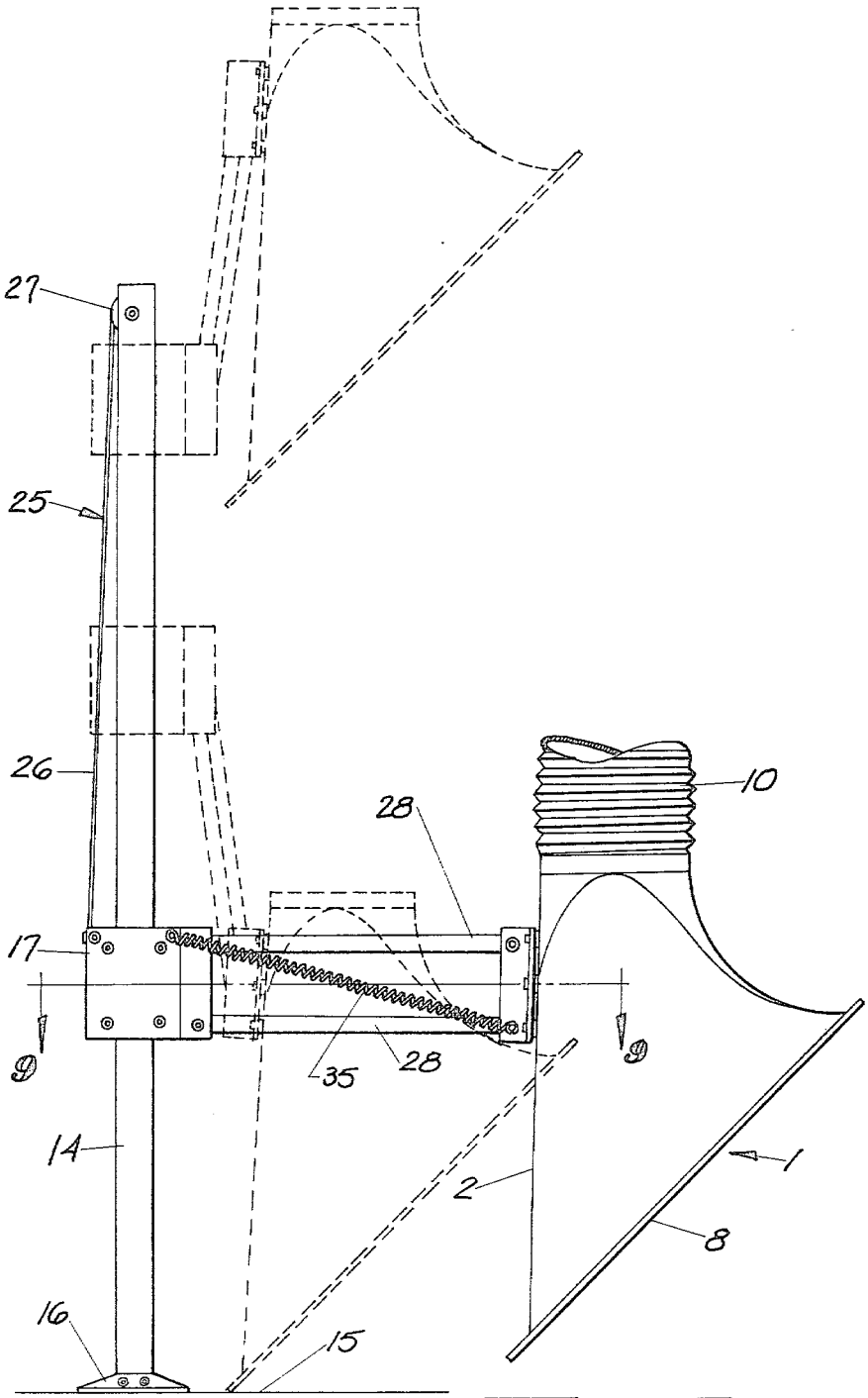
FIG. 7 is a fragmentary side elevation view of a third embodiment of the mounting structure for the source capture fume reduction apparatus of the present invention with the capture hood illustrated in alternate positions.
Figure 9:
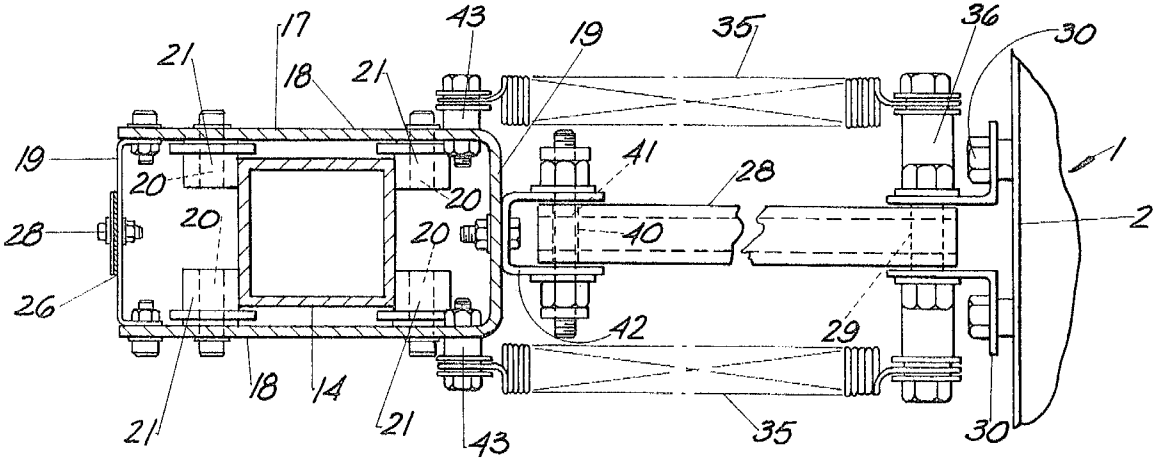
FIG. 9 is a fragmentary cross-sectional view taken along section line 9—9 of FIG. 7.

A third embodiment of the mounting means of the present invention is illustrated in FIG. 7 and FIG. 9, where similar elements have been similarly designated. This configuration provides for simultaneous vertical and pivotal movement, and includes the features found in the embodiments of FIG. 5 and FIG. 6 described hereinabove. In particular, the apparatus includes a vertical channel-like stanchion 14 mounted to a horizontal surface 15 of the work station by means of a mounting plate 16 or the like, a carriage 17 slidably movable along the stanchion, and a constant force spring 25 secured between the upper end of stanchion 14 and carriage 17, the spring acting to compensate for the weight of capture hood 1 and any attachments thereto such as flexible conduit 10 to maintain the hood at a desired vertical position.

The pivotal linkage mechanism described in connection with the embodiment of FIG. 6 is attached to carriage 17 as best shown in FIG. 19, and comprises a pair of parallel spaced arms 28, pivotally secured as at 29 to mounting bracket members 30 fixedly secured to rear wall 2 of capture hood 1. The other ends of arms 28 are pivotally secured as at 40 to a pivot bar 41 extending between the inwardly directed arms of a U-shaped mounting bracket 42 fixedly attached to the forward end wall 19 of carriage 17. A pair of spaced extension coil springs 35 are secured on either side of arms 28 between horizontally extending pivot bar 36 adjacent capture hood 1, and a pair of outwardly directed boss-like spring supports 43 affixed to the forward portion of carriage side walls 18. It will be observed that this mechanism permits pivotal movement independent of the vertical movement afforded by carriage 17, so that capture hood 1 may be caused to assume the range of adjustable positions illustrated in FIG. 7. As in the embodiments of FIG. 5 and FIG. 6, constant force spring 25 and extension springs 35 will be selected to compensate for the weight of hood 1 and any attachments thereto such as flexible conduit 10 to maintain the hood at a desired vertical and/or horizontal position.

It will be understood that various changes in the details and arrangements of parts, which have been herein described and illustrated in order to explain the nature of the invention, may be made by those skilled in the art within the scope and principal of the invention as expressed in the appended claims.

In particular, where used herein, the term "fumes" shall be understood to include fumes, smoke, vapors, dust, gas and the like.

The embodiments of the invention in which an exclusive property or privilege is claimed are as follows:

1. A fume capture hood for providing source capture of fumes produced at a work station comprising:

a generally vertically oriented rear wall portion;

a part of spaced generally vertical side wall portions extending smoothly forwardly from the side edges of said rear wall portion, the forwardmost sections of said side wall portions flaring outwardly throughout their major lengths to define concave surfaces;

an upper concave wall surface extending smoothly generally forwardly and downwardly from the upper edges of said rear and side wall portions, the forward edges of said side and upper wall portions defining a generally rectangular front opening sloping forwardly and upwardly at an angle of about 45°, the contours associated with the forward parts of said upper and side wall portions operating to reduce entrance loss and turbulence, the contour associated with the forwardmost part of said upper wall portion producing a higher inlet velocity near the top of the hood for increasing suction of fumes near an operator's breathing zone; and means associated with the upper end of said hood for attaching flexible conduit means to exhaust fumes captured by the hood, said attachment means including an opening extending into the hood and being defined by the confluence of the upper edges of said rear, side and upper wall portions, said fume capture hood including means for mounting said hood for vertical movement proximate the work station such that the orientation of said forward opening remains constant during vertical movement of the hood, said mounting means comprising:

a vertical stanchion mountable proximate the work station; and a carriage slidably movable along said stanchion means mounting said hood to said carriage and means associated with said carriage for automatically holding said hood at a preselected vertical position, said holding means comprising a constant force spring secured between said stanchion and said carriage, said spring acting to compensate for the weight of said hood and attachments thereto to maintain the hood at a desired vertical position.

2. The capture hood according to claim 1 wherein said concave surfaces of said side and upper walls define cylindrical surfaces.

3. The capture hood according to claim 2 wherein said rear wall portion extends upwardly and forwardly within about 3° of perpendicular.

4. The fume capture hood according to claim 3 including an outwardly flaring flange extending around the periphery of said front opening.

5. The fume capture hood according to claim 4 wherein said contours produce a coefficient of entry of at least about 0.93.

6. The fume capture hood according to claim 1 wherein said hood is molded from a fire resistant, non-electrically conducting material.

7. The fume capture hood according to claim 6 wherein said material is fiberglass.

8. The apparatus according to claim 1 including collection means comprising an electrostatic precipitator.

9. The apparatus according to claim 1 including collection means comprising a solvent recovery system.

10. The apparatus according to claim 1 wherein said mounting means includes a pair of parallel spaced arms pivotally attached at their ends to said carriage and said hood, respectively, and extension spring means extending between said hood and said carriage for holding said hood in a desired pivotal position.

* * * * *